US006213740B1

(12) United States Patent
Barnes

(10) Patent No.: US 6,213,740 B1
(45) Date of Patent: Apr. 10, 2001

(54) FLEXIBLE IMPELLER PUMP HAVING A TRANSPARENT SAFETY COVER

(76) Inventor: John Eastman Barnes, P.O. Box 402, Ashmore City (AU), QLD 4214

( * ) Notice: Subject to any disclaimer, the term of this patent is extended or adjusted under 35 U.S.C. 154(b) by 0 days.

(21) Appl. No.: 09/403,246

(22) PCT Filed: Apr. 16, 1998

(86) PCT No.: PCT/AU98/00264

§ 371 Date: Oct. 15, 1999

§ 102(e) Date: Oct. 15, 1999

(87) PCT Pub. No.: WO98/48172

PCT Pub. Date: Oct. 29, 1998

(30) Foreign Application Priority Data

Apr. 18, 1997 (AU) ..... PO6297

(51) Int. Cl.[7] ..... F04C 2/44; F04C 5/00; F04C 15/00

(52) U.S. Cl. ..... 418/2; 418/153; 418/154; 418/156

(58) Field of Search ..... 418/2, 69, 135, 418/142, 152, 153, 154, 156

(56) References Cited

U.S. PATENT DOCUMENTS

| | | | | |
|---|---|---|---|---|
| 1,953,297 | | 4/1934 | Good . | |
| 2,678,003 | * | 5/1954 | Gerken | 418/2 |
| 2,976,811 | * | 3/1961 | Sully | 418/153 |
| 3,054,355 | | 9/1962 | Neely . | |
| 3,592,572 | * | 7/1971 | Schnell | 418/2 |
| 4,538,962 | | 9/1985 | McCain | 416/146 R |
| 5,563,585 | | 10/1996 | MacDonald | 340/626 |

FOREIGN PATENT DOCUMENTS

| | | | | |
|---|---|---|---|---|
| 244389 | * | 5/1963 | (AU) | 418/153 |
| 44 10 800 | | 3/1994 | (DE) . | |
| 870662 | * | 6/1961 | (GB) | 418/154 |
| 2 076 068 | | 11/1981 | (GB) . | |
| 2 307 723 | | 6/1997 | (GB) . | |
| WO 97/43549 | | 11/1997 | (WO) . | |
| WO 99/48172 | | 10/1998 | (WO) . | |

* cited by examiner

*Primary Examiner*—John J. Vrablik
(74) *Attorney, Agent, or Firm*—Parkhurst & Wendel, L.L.P.

(57) ABSTRACT

A flexible impeller pump having a transparent safety cover. The pump includes a flexible impeller and a housing having a pump and cover. The pump end cover comprises a transparent safety cover which is capable of attachment to the housing. A transparent heat resistant insert is also in contact with the impeller. A spacing means separates the transparent heat resistant insert from the safety cover, thereby forming a chamber. Typically the transparent heat resistant insert is made of borosilicate glass and the transparent safety cover of acrylic plastic or polycarbonate plastic.

24 Claims, 6 Drawing Sheets

FLEXIBLE IMPELLER PUMP HAVING A TRANSPARENT SAFETY COVER

BACKGROUND OF THE INVENTION

This invention relates to improvements to rotary pumps and more specifically to pumps that incorporate rotating flexible impellers for their pumping action.

Most rotary pumps have a housing that allows access to an impeller via an end cover. The impeller is driven by a drive shaft that causes water to be drawn through an inlet at low pressure and expelled through an outlet at higher pressure.

There are a number of refinements that can be added to this basic design that will assist monitoring of pump performance and condition whilst increasing pump reliability and simplifying the servicing or repair of the pump when required.

In certain applications, such as marine engine cooling pumps, it is difficult to identify if the pump is the cause of engine overheating without partial dismantling of the pump to visually inspect the flexible impeller for damage.

In numerous marine engine installations access to the pump is extremely difficult because of restricted access in the engine compartment and the physical location of the cooling pump on the engine.

In some cases it becomes necessary to remove adjacent parts of the engine such as alternators and drive belts, heat exchangers etc, to gain access to the cooling pump which can be quite hazardous in rough seas with an overheated engine.

It is an object of this invention to overcome at least some of the above disadvantages or provide the consumer with a useful or commercial choice.

SUMMARY OF THE INVENTION

In one form the invention resides in a pump including a flexible impeller and a housing having a pump end cover, the pump end cover comprising:

- a transparent safety cover able to be attached to the housing;
- a transparent heat resistant insert able to contact the impeller; and
- a spacing means to space the transparent heat resistant insert from the transparent safety cover.

The transparent heat resistant insert may be made from any suitable material and may be of any suitable shape or size. Preferably, the transparent heat resistant insert is made from borosilicate glass.

The transparent safety cover may be made from any suitable material and may be of any suitable shape or size. Preferably the transparent safety cover is made from an acrylic plastics such as perspex or a polycarbonate plastics such as lexan.

The spacing means may be made of any suitable form. For example the spacing means may be a mounting ring. The spacing means may hold the transparent insert at a fixed distance from the transparent safety cover. Alternatively, the spacing means has a positioning means that allows the transparent heat resistant insert to position itself against the impeller. The positioning means may be a substantially flexible "O" ring. The "O" ring may be hollow.

The pump end cover may be attached to the housing by mounting means. The mounting means may include a mounting fastener that is able to extend through the pump end cover, and a retaining sleeve to prevent unwanted removal of the mounting screw from the pump end cover.

The mounting fastener may be a standard fastener such as an allen bolt or Phillips head screw.

The retaining sleeve may be formed from any suitable tubular flexible material. Preferably the retaining sleeve is made of natural or synthetic rubber.

The impeller may include a hub that is able to be attached to a drive shaft, and a plurality of flexible blades extending outwardly from the hub, wherein the blades are removable from the hub.

The blades may be inserted or removed from the hub by moving the blades in an axial direction relative to the hub.

The hub may have a plurality of equally spaced profiled slots into which corresponding end portions of the blades can be inserted.

Each blade may be substantially symmetrical such that either end portions of the blade can be inserted into a profiled slot.

The blades and hub may be made from different materials having different wear properties so that both the hub and the blades operate more effectively.

A seal may be located on at least one end of the hub to establish substantially water tight zones between respective blades. Preferably, the seal is an "O" ring.

The impeller may also include a threaded hole that is in communication with a drive boss such that a threaded shank can be rotated within the threaded hole to remove the drive boss from the drive shaft.

The shank may be of any suitable form. Preferably, the threaded shank forms part of a bolt. Hence a required amount of torque can be applied to the bolt through the use of a spanner or the like.

The drive shaft may be attached to the impeller by a lost motion device that allows at least limited relative rotation between the drive shaft and the impeller.

The lost motion device may be of any suitable form. Typically, the lost motion device includes at least one impeller key mounted to the impeller and at least one drive shaft key mounted to the drive shaft such that upon rotation of the drive shaft the keys contact each other to rotate the impeller.

Preferably the lost motion device comprises a hollow ring mountable to the impeller having three equally spaced impeller keys formed on an inner circumference of the ring, and a collar mountable to the drive shaft having three equally spaced drive shaft keys formed on an outer circumference of the collar.

A pressure sensing nipple may used to determine the pressure within the pump and also fasten a cam of the pump. After much trial and experimentation it has been found that placement of the nipple through the cam will give a value of pressure proportional to the outlet pressure of the pump.

A temperature warning device may be attached to the transparent heat resistant insert to monitor the temperature of the pump.

The temperature warning device may be attached adjacent the centre of the transparent heat resistant insert as heat generated by friction of the impeller rubbing against the pump will at be at its most intense at the centre of the transparent insert.

In another form, the invention resides in a pump end cover including:

- a transparent safety cover able to be attached to a pump housing;
- a transparent heat resistant insert able to contact the impeller; and
- a spacing means to space the transparent heat resistant insert from the transparent safety cover.

The pump end cover may have the same features as described previously.

In another form the invention resides in an the impeller including:

a hub able to be attached to a drive shaft and a plurality of flexible blades extending outwardly from the hub;

wherein the blades are removable from the hub.

The impeller may have the same features as described previously.

In another form the invention resides in a removable blade for a flexible impeller including an end portion that is able to be inserted within a profiled slot of a hub of the impeller.

The blade may have the same features as described previously.

In another form, the invention resides in an impeller including a threaded aperture that is in communication with a drive boss of an impeller such that a threaded shank can be rotated within the threaded hole to move the shank inwardly to remove an impeller drive boss from a drive shaft.

The impeller may have the same features as described previously.

In another form, the invention resides in a lost motion device for connecting a drive shaft to an impeller, the lost motion device allowing reverse rotation of the drive shaft of less than 360 degrees without rotation of the impeller.

The lost motion device may have the same features as described previously.

In another form the invention resides in a pressure sensing nipple that is used to determine the pressure within the pump and also to fasten a cam of the pump.

The pressure sensing nipple may have the same features as described previously.

In another form the invention resides in a temperature warning device for a pump, the temperature warning device attached to an end cover to monitor the temperature of the pump.

The end cover may be constructed from any suitable materials such as metal. Preferably the end cover is constructed similar to that described previously.

The temperature warning device may be attached adjacent the centre of the end cover.

The temperature warning device may be attached to the transparent heat resistant insert.

BRIEF DESCRIPTION OF THE DRAWINGS

Embodiments of the invention will now be described with reference to the accompanying drawings in which.

DETAILED DESCRIPTION OF THE PREFERRED EMBODIMENT

Figure 1:
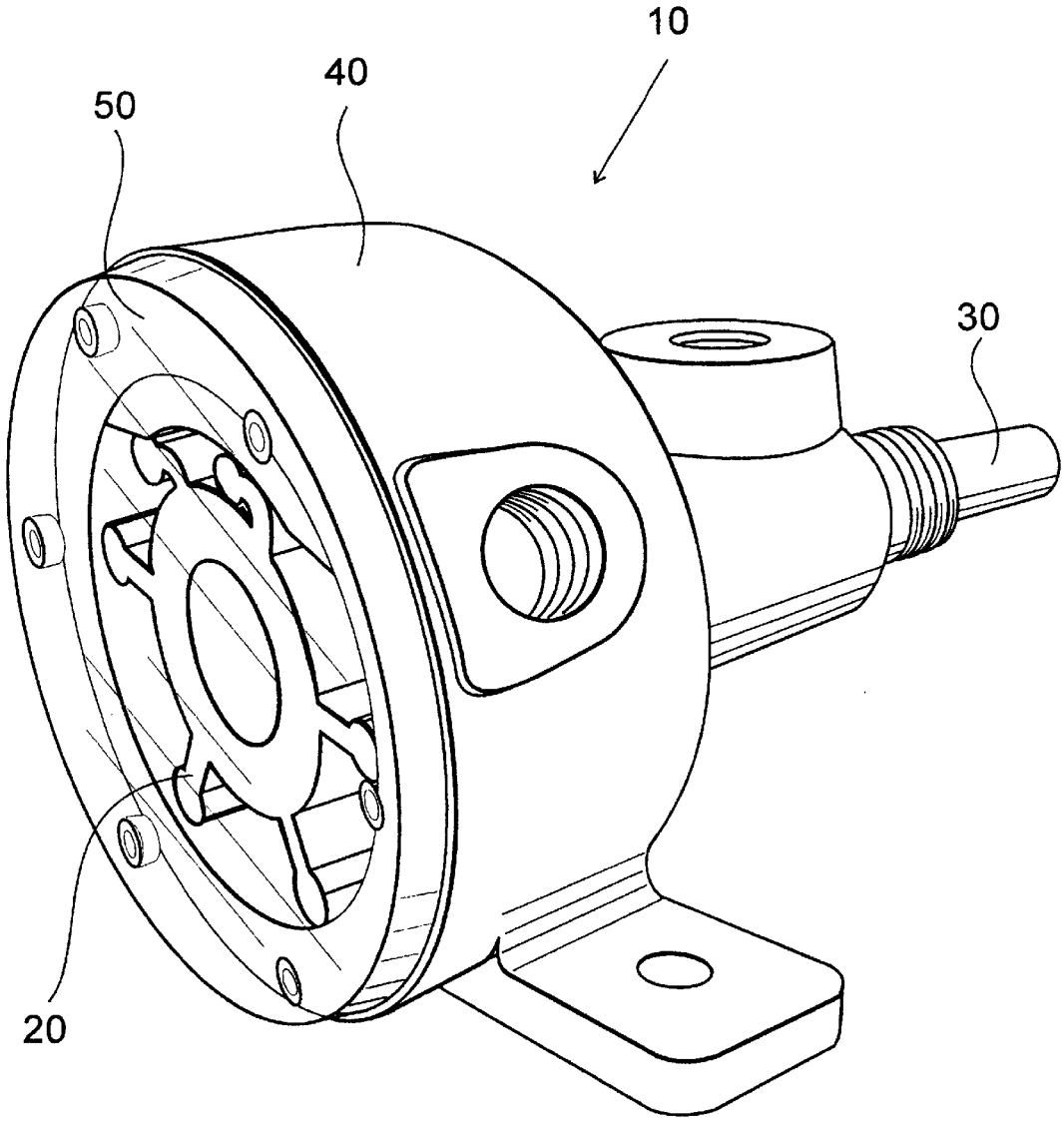
FIG. 1 is a perspective view of a marine engine cooling pump according to one embodiment of the invention.

FIG. 1 shows a pump 10 having a flexible impeller 20 connected to a drive shaft 30 and a housing 40 having a transparent pump end cover 50. As can been seen with respect to FIG. 1, it is possible to check the condition of the impeller 20 without the need to dismantle the pump 10 by looking at the impeller 20 through the transparent pump end cover 50.

Figure 2:
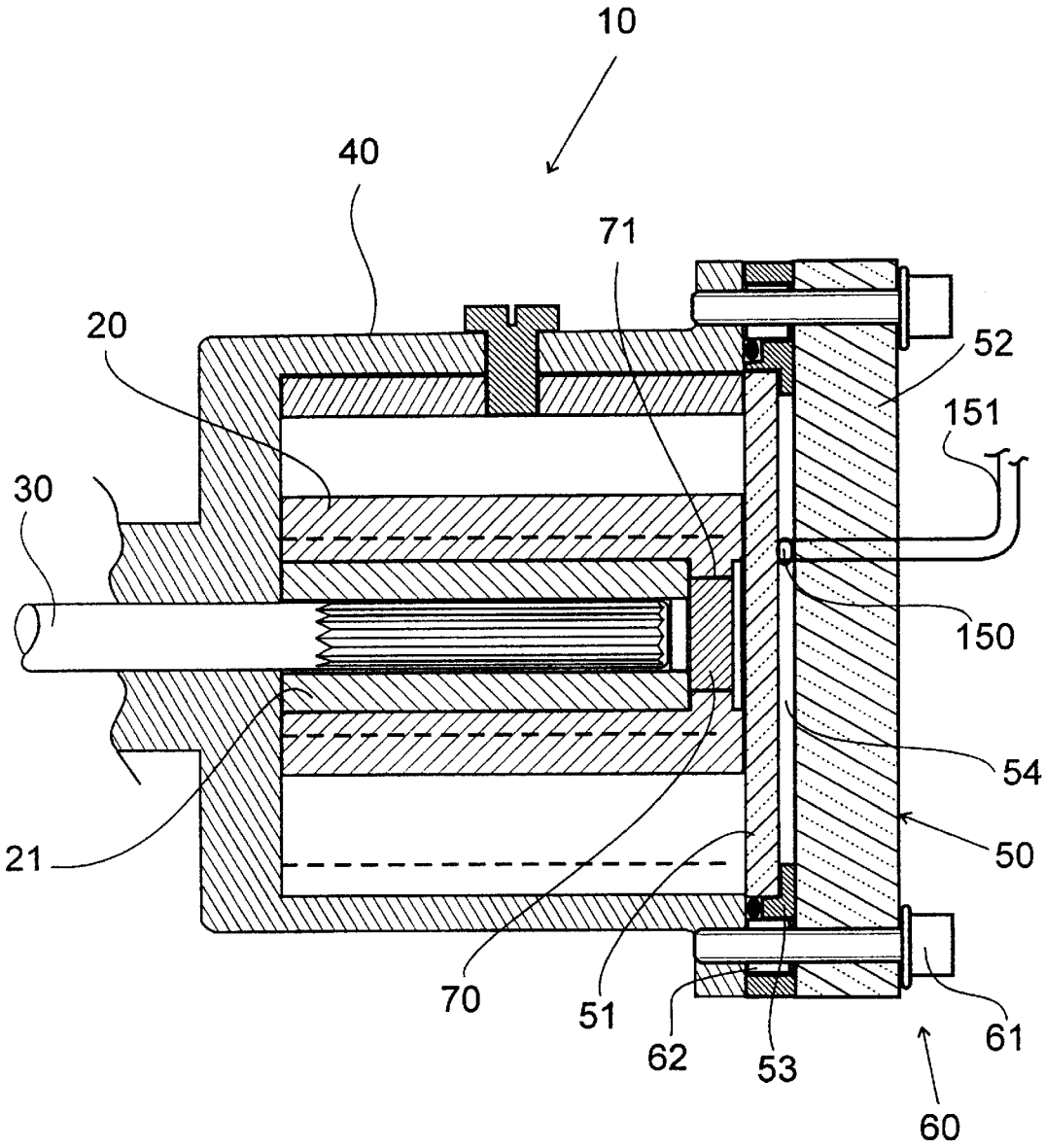
FIG. 2 is a cross sectional view of the marine engine cooling pump of FIG. 1.

FIG. 2, is a cross sectional view of the pump 10 which shows the impeller 20 located in the pump housing 40 to which is attached a transparent pump end cover 50 consisting of a borosilicate glass insert 51, glass insert mounting ring 53 and transparent safety cover 52.

A well known problem with existing pump end covers manufactured out of metal is the wear experienced on the inside face of the pump end cover as a result of the continual rubbing action of the flexible impeller as the end cover acts as a retaining, sealing plate for the impeller.

The use of a heat resistant and hardened borosilicate glass greatly reduces wear and the possibility of glass failure due to thermal stress from heat buildup caused by friction between the impeller and adjacent surface of glass insert.

As presented in FIG. 2, the transparent pump end cover 50 can be further strengthened with the addition of a transparent safety cover 52 which also serves as a containment barrier in the event of failure of the glass insert 51.

The addition of a transparent safety cover 52 is a most desirable feature when pumping dangerous or corrosive fluids or in marine engine applications where the pump may be mounted below the waterline of the vessel and any failure of the glass insert could result in flooding of the vessel.

It may seem obvious that a laminated glass pump end cover having a glass cover and glass insert, or glass cover and plastic insert and being adhered together using a suitable transparent adhesive film between the insert and cover, could form the basis of a pump end cover. However field tests have proven this design to be impractical.

It is well known that during periods of dry running, heat build up caused by friction between the rotating flexible impeller and the inside surface of glass insert can reach levels capable of damaging the rubber impeller. In practice this heat build up can also affect the structural properties of the bonding adhesive thus reducing the effectiveness of the this type of pump end cover.

Thus yet another feature of the transparent pump end cover 50 shown in FIG. 2, is the incorporation of a hollow chamber 54 filled with air located between the glass insert 51 and the transparent safety cover 52 which greatly reduces the risk of heat distortion or failure of the transparent safety cover 52. The hollow chamber 54 filled with air acts as an insulation barrier where any heat buildup in the glass insert 51 is not directly transferred to the transparent safety cover 52 which is more susceptible to heat distortion than the glass insert 51.

Whilst the transparent pump end cover design shown in FIG. 2, is satisfactory for the smaller sizes of pumps, problems with larger models can be experienced because of heat build up between the inside of the glass insert's surface adjacent to a centre mounting boss of the impeller.

This build up of heat is caused by friction as a result the production tolerances of the flexible impeller 20 and/or pump housing 40.

Any of these variables or a combination of them can result in the clearance between the inside surface of the glass insert 51 and the impeller 20 being too tight thereby building up heat which can result in premature failure of the glass insert 51 or failure of the impeller 20 or both.

On the other hand if a thick seat was installed the pump 10 would cavitate because of too much clearance between the end of the impeller 20 and the glass insert 51 and although this situation is not destructive to the impeller 20 or the glass insert 51 it can reduce pumping efficiency or even prevent the pump 10 from operating.

Figure 3:
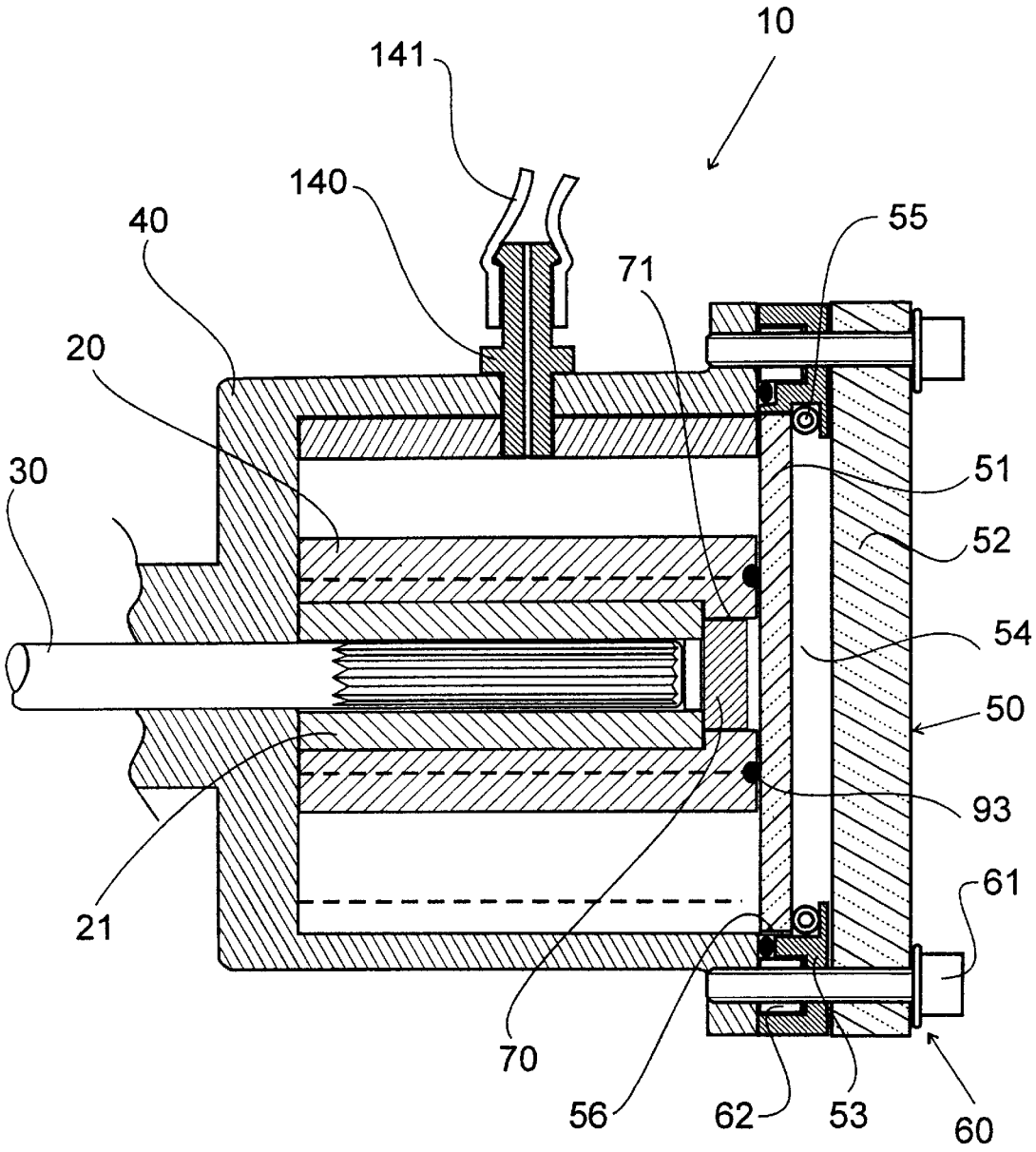
FIG. 3 is another cross sectional view of a marine engine cooling pump according to another embodiment of the invention.

FIG. 3, is an arrangement that addresses these problems by use of a glass insert 51 that is allowed to automatically position itself in relation to the adjacent face on impeller 20.

In the example as shown in FIG. 3, transparent pump end cover 50 is designed to accommodate a glass insert 51 and a circular hollow flexible "O" ring seal 55 bonded between the outside surface of the glass insert 51 and the inside surface of the mounting ring 53 thereby providing a water proof seal between the mounting ring 53 and the glass insert 51.

The flexible seal 55 can be manufactured out of a suitable material such as high temperature silicone rubber which has excellent resilience and memory properties so that it can perform the functions of both a seal and resilient spring.

Thus it can be seen that glass insert 51 can position itself against an outer face of the impeller 20 and compensate for the variables previously described. FIG. 3, also includes flat sections 56 on the outer edge of glass insert 51 and the inside of mounting ring 53 to prevent the glass insert 51 from rotating.

A further problem associated with the removal and replacement of the transparent pump end cover 50 is the risk of dropping the mounting screws especially at sea in rough conditions.

FIGS. 2 and 3 show mounting means 60 where mounting screws 61 are held captive by a flexible retaining sleeve 62 located in hole of the mounting ring 53.

This simple and effective arrangement provides mounting means 60 where the screws 61 can initially be rotated by hand to start the screw into a threaded hole of the pump 10 and finally be tightened securely with a suitable tool such as an hexagonal key or spanner or screwdriver depending on the type of screw head.

FIGS. 2 and 3 also show a flexible plug 70 installed in recess 71 of the flexible impeller that is designed to reduce the ingress of fluid and build up of salt or corrosion between the drive shaft 30 and an impeller drive boss 21.

It is not uncommon for the impeller 20 to seize on the drive shaft 30 which requires the use of a special removal tool similar in design to the well known multiple leg adjustable bearing puller.

Figure 4:
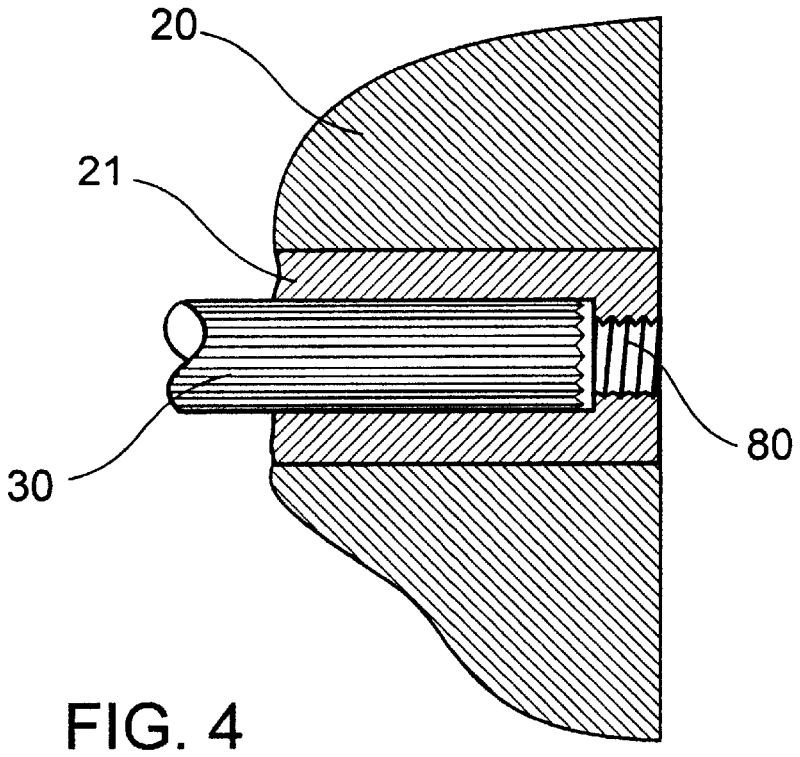
FIG. 4 is a partial sectional view of an impeller attached to a pump drive shaft.

A very simple and effective design change of the impeller drive boss totally eliminates the need for the previously described impeller removal tool and is presented in FIG. 4.

FIG. 4 shows a portion of a cross section of an impeller drive boss 21 assembled in the normal position on drive shaft 30. The impeller drive boss 21 has been modified to include a threaded hole 80 at the impeller outer end that can accept a threaded bolt 81 for removal of the impeller 20 from the drive shaft 30 as shown in FIG. 5.

Figure 5:
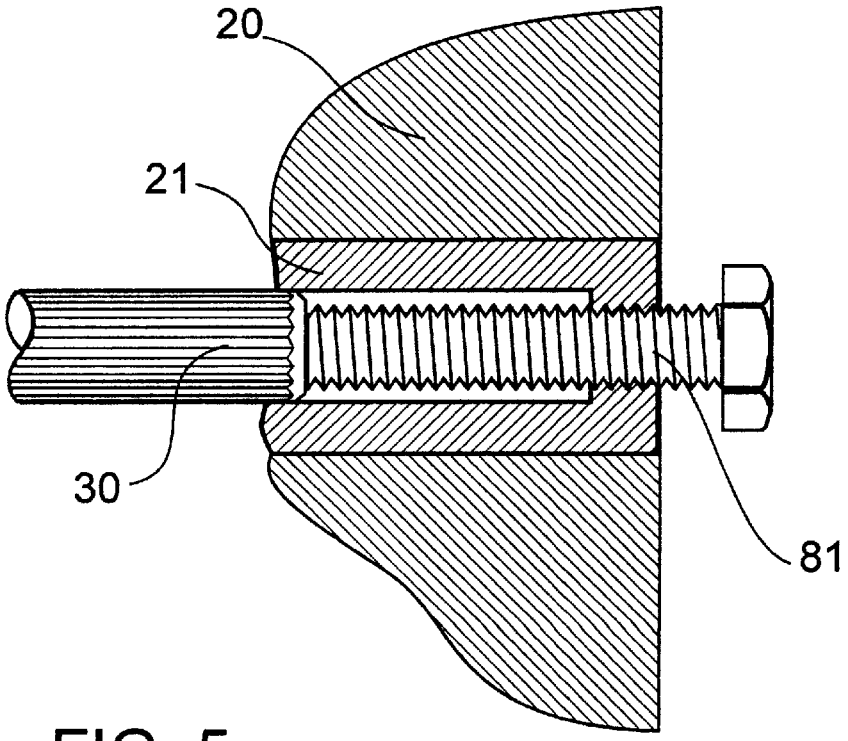
FIG. 5 is a is further partial sectional view of an impeller attached to a pump drive shaft.

FIG. 5 shows the same portion of an impeller cross section where the threaded bolt 81 has been screwed into the impeller drive boss 21 thus extracting the complete impeller 20 from the drive shaft 30 to a position where the impeller can be removed by hand.

Figure 6:
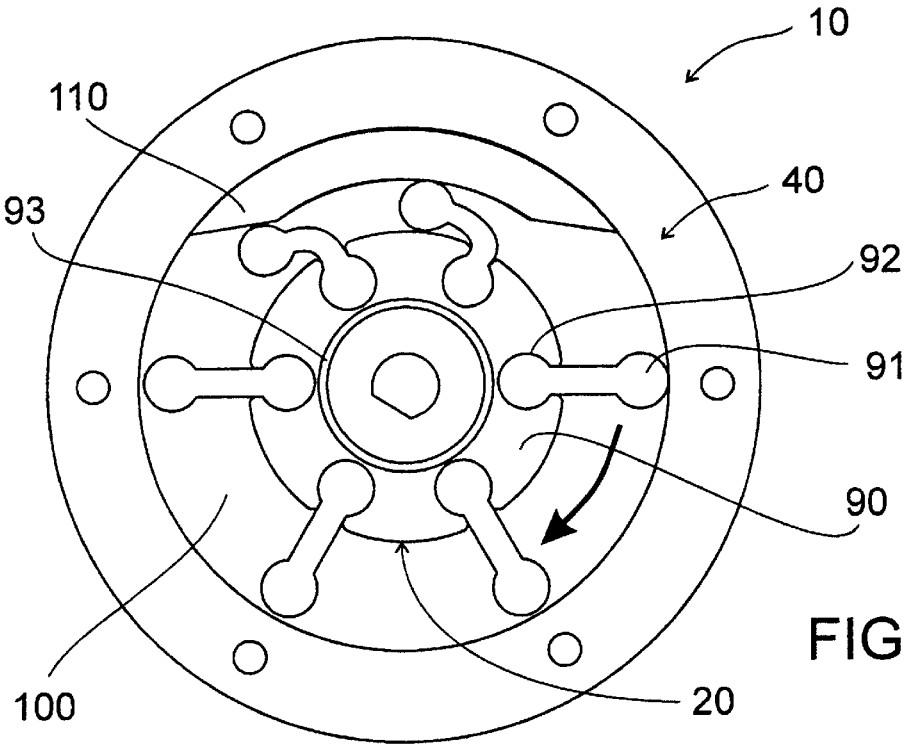
FIG. 6 is an end elevation of a marine engine cooling pump according to another embodiment of the invention.
Figure 7:
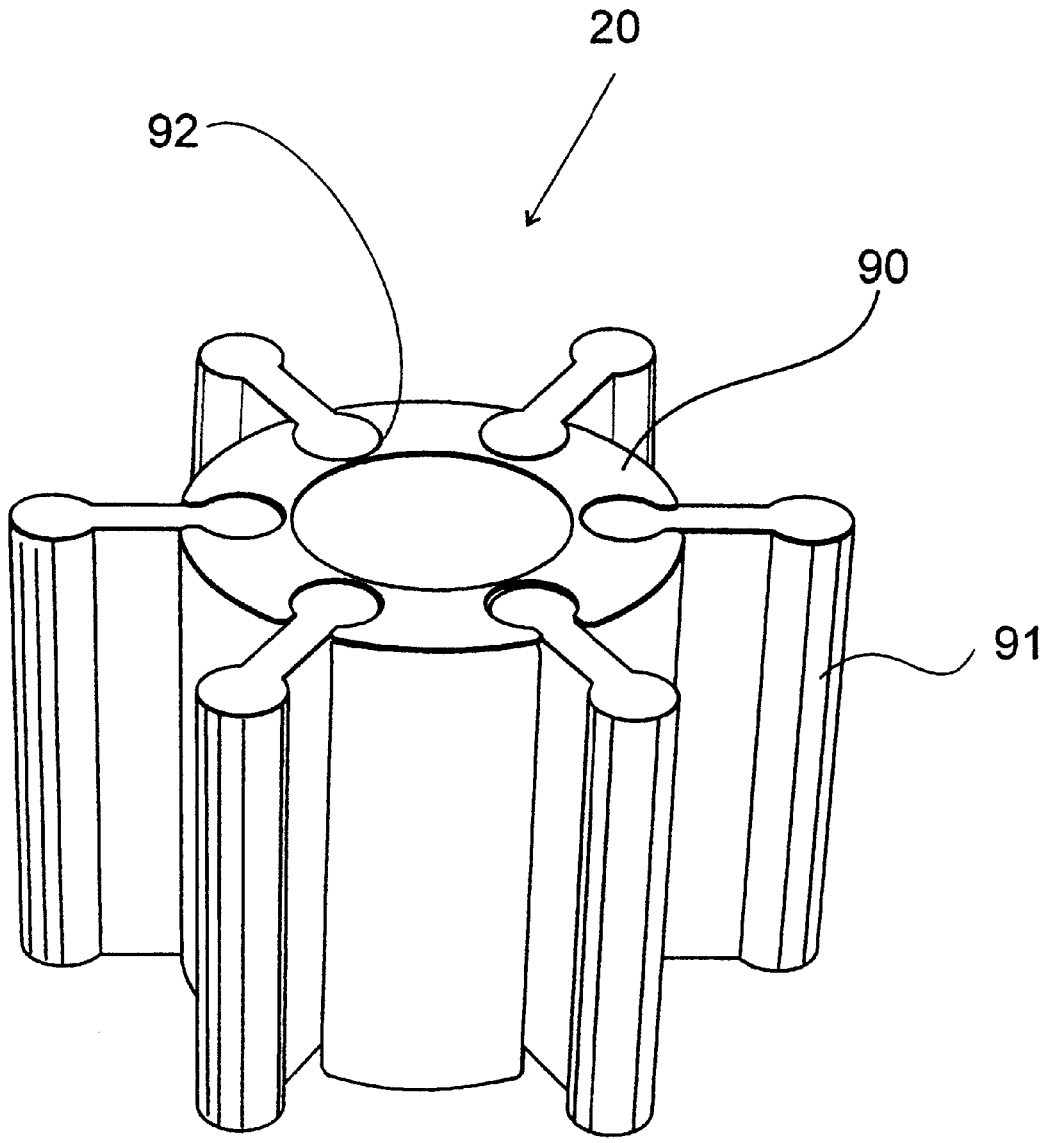
FIG. 7 is a perspective view of a impeller used in the marine cooling pump shown in FIG. 6.

Another improvement to impeller design and reliability involves the use if a solid impeller hub 90 with replaceable blades 91 slotted into the impeller hub 90 as described in FIGS. 6 and 7.

FIG. 6 shows an end elevation of an impeller 20 that consists of a solid hub 90 with a series of profiled slots 92 positioned around longitudinal axis of the hub 90 and shaped to accept a number of matching flexible impeller blades 91.

By virtue of their shape, the impeller blades 91 will remain in place in profiled slots 92 thus resisting centrifugal force or pump cam impeller blade distortion forces during rotation and being restrained longitudinally by the transparent pump end cover 50 when the pump 10 is installed in a pump housing.

With reference to FIGS. 6 and 7, the normal failure mode of a conventional flexible impeller occurs when the impeller blades tear away from the impeller hub in the vicinity of the base of the impeller blades and is caused by the stress involved as the individual blades pass over the pump cam.

This failure mode is accelerated if the pump is deprived of liquid for even short periods of time typically 10–20 seconds which results in a rapid build up of heat caused by friction between the end faces of the impeller assembly and the inside faces of the pump well and the transparent pump end cover 50.

This heat is concentrated in the area previously referred to in FIG. 2, as being adjacent to the base of the impeller blades and the impeller hub and rapidly conducts along the full length of the impeller hub thereby causing breakdown of the physical properties of the impeller material and premature failure of the impeller blades.

Thus it can be seen that by selection of the appropriate materials of the impeller blades and hub as described in FIG. 6, it is possible to manufacture a more reliable impeller assembly resistant to the effects of heat and/or deterioration caused by hostile fluids.

The concept of removable replacement blades 91 can have appeal to the end user and is a cost effective solution because higher performance materials can be used for impeller blade construction without the requirement to manufacture the remainder of the impeller from the same material.

In order to improve the efficiency of a typical rotary flexible impeller pump 10 and enhance the ability to self prime the overall length of the impeller blades 91 are slightly longer than the depth of the pump housing 40, and each zone 100 between the impeller blades must be effectively sealed when the pump is assembled and in operation.

Based on the previous comments relating to the use of a hardened heat resistant material with good insulation properties for the impeller hub 90 combined to production tolerances of the pump housing 40 or impeller hub 90, it is necessary to incorporate a heat resistant flexible material such as high temperature silicone rubber "O" ring 93 at the end face of the impeller hub to compensate for variations in impeller dimensions or pump wear.

With reference to FIG. 6, a flexible heat resistant "O" ring 93 is set into the impeller hub 90 to effectively seal each zone 100 located between adjacent impeller blades 91. a side elevation of this arrangement is also shown in FIG. 3, where "O" ring 93 is set into a groove in hardened impeller boss.

This arrangement minimizes the surface contact area between the impeller face and the transparent pump end cover 50 thus reducing heat caused by friction which is an advantage over conventional impeller design, as shown in FIG. 2.

Reciprocating type piston engines which are commonly used in marine applications normally have flexible vane rotary cooling pumps directly driven by the engine crank shaft or via drive belts and pulleys or gears.

Thus these engine driven cooling pumps can be considered to be coupled to the rotary motion of the crankshaft and as such will rotate in a fixed direction relative to normal engine rotation for the supply of coolant flow.

In the example shown in FIG. 6, this engine driven cooling pump 10 has a normal clockwise rotation therefore the blades 91 will normally be displaced to the left as they pass over a pump cam 110 and this normal direction of rotation is recommended by impeller manufacturers whilst installation of an impeller 20 is in progress. This installation procedure is designed to minimize stress on the impeller blades 91 during the subsequent start up of the engine. It should also be noted that some small electric pumps will fail to run if the impeller is inserted with incorrect impeller rotation.

During shutdown of a piston engine it is normal on the final revolution for the engine to kick back against compression and rotate in the opposite direction typically up to 90 degrees depending on engine condition, number of cylinders, etc. This final stopping action subjects the impeller 20 to great stress as the blades 91 are folded back on themselves as they pass over the cam 110 in the wrong direction.

Whilst this action may not result in failure of the impeller blades 91 on a relatively new impeller it can be quite destructive on an aged impeller 20 where the blades 91 have become less resilient and flexible. During lengthy periods of engine idleness the blades 91 adjacent to the cam 110 can be set in the wrong direction thereby greatly increasing the chance of impeller 20 failure during the next period of engine operation.

Figure 8:
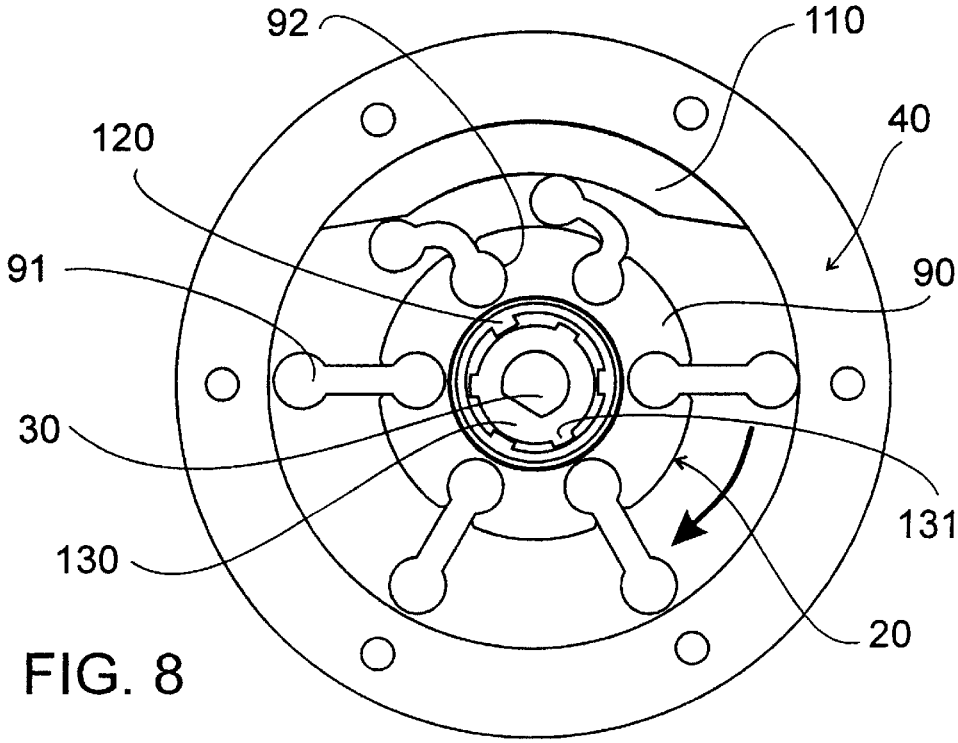
FIG. 8 is a further end elevation of a marine engine cooling pump according to another embodiment of the invention.

FIG. 8, shows an impeller end elevation 8 where the impeller 20 includes a hub 90 having inwardly extending circumferentially spaced keys 120 and the drive shaft consists of a collar 130 having outwardly extending, circumferentially spaced keys 131 arranged in such a manner to form a lost motion device that enables the drive shaft 30 to rotate approximately 100 degrees in the opposite direction from the normal direction of rotation without a corresponding movement of the impeller 20.

Thus when a stopping engine kicks back against compression the impeller remains in the normal rotational position whilst the drive shaft 30 and collar 130 moves in the opposite direction thereby greatly relieving subsequent stress on the impeller blades 91 and therefore prolonging impeller life.

This type of impeller design has the added advantage of being relatively easy to remove because the lost motion device is by design a relatively loose fit between hub 90 and collar 130.

FIG. 3, shows yet another simple improvement in the ability to remotely monitor pump performance as a conventional cam screw is replaced with a hollow nipple 140 that acts both as a cam retaining screw and a pressure sensing line attachment fitting.

It has been found that the pressure tested at this point is proportional to pump outlet pressure and serves as a convenient place to connect a pressure gauge and/or pressure switch for monitoring pump performance via hose 141.

Alternatively a direct reading pressure gauge or pressure transmitter or pressure switch or combination of each could be directly mounted to the cam screw attachment point without the need of additional hardware or plumbing.

In situations where engines are being run unattended to operate generators or refrigeration etc, a pressure switch (not shown) could be setup to automatically shut down the engine thus preventing the possibility of impeller or engine damage from a blocked, restricted or broken pump inlet line.

The connection of a suitable warning device via a pressure switch would provide an early warning of potential impeller damage should the pump inlet become blocked by some foreign object such as a plastic bag or seaweed.

Because of the relative mass of the engine in most cases the usual technique of monitoring engine operating temperature via a gauge or warning device will not provide a sufficiently early warning period to prevent impeller damage caused by a blocked pump inlet.

Another technique in the monitoring of flow through a flexible impeller pump is to manually feel the temperature at the centre area of the transparent pump end cover 50.

As already discussed a reduction or cessation of flow rapidly increases the temperature of the transparent pump end cover 50 and this temperature increase can be monitored by means of a temperature switch or similar device attached to the outside surface of a typical metal end cover.

In the example shown in FIG. 2, the temperature monitoring device consists of a thermistor 150 bonded to the surface of the glass insert 51 inside air chamber 54 with suitable wires 151 passing through transparent safety cover 52 for connection to a warning, indicating and/or engine shut down device (not shown).

It should be appreciated that various other changes and modifications may be made without departing from the spirit or scope of the invention.

What is claimed is:

1. A fluid pump including a flexible impeller and a housing having a pump end cover, the pump end cover comprising:

a transparent safety cover removably attachable to the housing;

a transparent heat resistant insert in contact with a free end of the impeller; and a spacer to space the transparent heat resistant insert from the transparent safety cover to form a hollow chamber.

2. The pump of claim 1 wherein transparent heat resistant insert is made of borosilicate glass.

3. The pump of claim 1 wherein transparent safety cover is made of an acrylic plastic or a polycarbonate plastic.

4. The pump of claim 1 wherein the spacer is a mounting ring.

5. The pump of claim 4 wherein the spacer is resiliently deformable to permit, in use, resilient biassing of said heat resistant insert against said free end of said impeller.

6. The pump of claim 5 wherein said spacer is a flexible "O" ring.

7. The pump of claim 1 wherein the pump end cover is attached to the housing by mounting members, the mounting members comprising:

having respective shanks extending mounting screws through the pump end cover; and retaining sleeves secured over respective shanks to captively retain said mounting screws in said pump end cover mounting screw from pump end cover.

8. The pump of claim 7 wherein said retaining sleeves are formed from a tubular flexible material.

9. The pump of claim 8 wherein said retaining sleeves are made of rubber.

10. The pump of claim 1 wherein the impeller comprises:

a hub removably attachable to a drive shaft and a plurality of flexible blades extending outwardly substantially radially from the hub, said pump characterized in that the blades are removable from the hub.

11. The pump of claim 10 wherein the blades can be inserted or removed from the hub by moving the blades in a axial direction relative to the hub.

12. The pump of claim 11 wherein the hub has a plurality of equally spaced profiled slots into which corresponding end portion of the blades can be inserted.

13. The pump of claim 12 wherein the blade is substantially symmetrical such that either of opposed end portions of the blade can be inserted into a profiled slot.

14. The pump of claim 13 wherein the blades and hub are made from different materials.

15. The pump of claim 14 wherein a seal is located at a free end of the hub against said heat resistant insert to establish substantially fluid tight zones between respective blades.

16. The pump of claim 15 wherein the seal is an "O" ring.

17. The pump of claim 1 wherein the impeller includes a hub having a screw threaded aperture axially aligned with a drive shaft for said impeller such that a screw threaded member can be rotated within the screw threaded aperture to displace said impeller from said drive shaft.

18. The pump of claim 17 wherein the screw threaded member comprises a set screw or bolt.

19. The pump of claim 1 wherein a drive shaft is attached to said impeller by a lost motion device which allows at least relative rotation between the drive shaft and the impeller.

20. The pump of claim 19 wherein the lost motion device includes at least one hub abutment and at least one shaft abutment, said at least one hub abutment and said at least on shaft abutment being engagable upon relative rotation between said impeller and said drive shaft to drive said impeller.

21. The pump of claim 20 wherein the lost motion device comprises a tubular hub member having a plurality of inwardly directed circumferentially spaced hub keys engagable with a plurality of outwardly directed circumferentially spaced shaft keys.

22. The pump of claim 1 wherein a pump cam fastener comprises a longitudinally extending aperture in fluid communication with an interior region of said pump.

23. The pump of claim 1 wherein a temperature warning device is attached to the transparent heat resistant insert to monitor temperature changes in said pump.

24. The pump of claim 23 wherein the temperature warning device is attached adjacent the centre of said transparent heat resistant insert.

* * * * *